US006715191B2

(12) United States Patent
Adzima et al.

(10) Patent No.: US 6,715,191 B2
(45) Date of Patent: Apr. 6, 2004

(54) CO-TEXTURIZATION OF GLASS FIBERS AND THERMOPLASTIC FIBERS

(75) Inventors: Leonard J. Adzima, Pickerington, OH (US); Timothy A. Miller, Newark, OH (US)

(73) Assignee: Owens Corning Fiberglass Technology, Inc., Summit, IL (US)

( * ) Notice: Subject to any disclaimer, the term of this patent is extended or adjusted under 35 U.S.C. 154(b) by 205 days.

(21) Appl. No.: 09/895,922

(22) Filed: Jun. 28, 2001

(65) Prior Publication Data

US 2003/0000055 A1 Jan. 2, 2003

(51) Int. Cl.[7] ..... D02G 1/16
(52) U.S. Cl. ..... 28/247; 28/271; 28/289
(58) Field of Search ..... 28/271, 273, 274, 28/275, 276, 258, 220, 178; 65/438, 443

(56) References Cited

U.S. PATENT DOCUMENTS

| | | | | | |
|---|---|---|---|---|---|
| 2,851,737 | A | | 9/1958 | Hunter et al. | |
| 3,276,931 | A | | 10/1966 | Rees | |
| 3,802,038 | A | * | 4/1974 | Bauch et al. | 28/255 |
| 3,827,114 | A | * | 8/1974 | Crossfield | 28/271 |
| 4,470,252 | A | * | 9/1984 | Brodmann | 65/438 |
| 4,569,471 | A | | 2/1986 | Ingemansson et al. | |
| 4,667,864 | A | * | 5/1987 | Kiteck | 226/97.4 |
| 4,741,151 | A | * | 5/1988 | Klink et al. | 57/350 |
| 4,776,162 | A | | 10/1988 | Glaser et al. | |
| 4,860,407 | A | | 8/1989 | Roess | |
| 4,932,108 | A | * | 6/1990 | Brodmann | 28/271 |
| 5,011,523 | A | | 4/1991 | Roncato et al. | |
| 5,025,533 | A | | 6/1991 | Faas et al. | |
| 5,293,676 | A | * | 3/1994 | Geirhos et al. | 28/271 |
| 5,316,601 | A | | 5/1994 | Hebbard et al. | |
| 5,688,594 | A | * | 11/1997 | Lichscheidt et al. | 428/370 |
| 5,766,541 | A | | 6/1998 | Knutsson et al. | |
| 5,792,555 | A | | 8/1998 | Bak et al. | |
| 5,879,800 | A | * | 3/1999 | Geirhos | 428/370 |
| 5,910,361 | A | | 6/1999 | Guevel et al. | |
| 5,976,453 | A | | 11/1999 | Nilsson et al. | |
| 6,013,223 | A | | 1/2000 | Schwarz | |
| 6,109,016 | A | | 8/2000 | Geirhos | |
| 6,370,747 | B1 | * | 4/2002 | Lewin et al. | 28/271 |

FOREIGN PATENT DOCUMENTS

| | | |
|---|---|---|
| DE | 44 44 917 | 6/1996 |
| EP | 0 156 600 | 10/1985 |
| WO | WO 98/24615 | 6/1998 |

* cited by examiner

*Primary Examiner*—A. Vanatta
(74) *Attorney, Agent, or Firm*—Inger H. Eckert; Stephen W. Barns; Maria C. Gasaway

(57) ABSTRACT

A method of co-texturizing glass fibers and thermoplastic fibers comprises passing a glass fiber strand through a texturizing gun, simultaneously passing a thermoplastic fiber strand through the texturizing gun with the glass fiber strand and injecting pressurized air into the texturizing gun concurrently with the glass fiber strand and thermoplastic fiber strands. This method produces a co-texturized fiber material comprising between 20–85% by weight glass fiber and 15–80% by weight thermoplastic fiber having an overall density of from about 20 grams/liter to about 200 grams/liter, and preferably from about 20 grams/liter to less than about 30 grams/liter.

9 Claims, 1 Drawing Sheet

CO-TEXTURIZATION OF GLASS FIBERS AND THERMOPLASTIC FIBERS

TECHNICAL FIELD AND INDUSTRIAL APPLICABILITY OF THE INVENTION

This invention relates to the co-texturization of reinforcing fibers and thermoplastic fibers and the resulting composite product.

BACKGROUND OF THE INVENTION

It is common to include sound absorbing material in engine exhaust mufflers to dampen or attenuate the sound made by engine exhaust gases as they pass from the engine through the exhaust system to the atmosphere. One technological approach to this problem is disclosed in U.S. Pat. No. 4,569,471 to Ingemansson et al. The Ingemansson et al. patent describes a process and apparatus for feeding lengths of continuous glass fiber strands into a muffler outer shell. The apparatus includes a nozzle for expanding the fiber strands into a wool-like material before the fiber strands enter the outer shell. The nozzle disclosed in the Ingemansson et al. patent is capable of expanding strand material to a density of about 70 grams/liter or more. While such material is useful for its intended purpose, it has also been found that lower density materials of between about 30 grams/liter to about 60 grams/liter are desirable for many sound and thermal insulation applications.

U.S. Pat. No. 5,766,541 to Knutsson et al. discloses methods and apparatus for making preforms from continuous glass fiber strand material and binder material. Such preforms may be produced at a central location in order to reduce equipment costs and then the preforms may be shipped to other locations where they may be combined with muffler shells during subsequent assembly operations. The method disclosed in the Knutsson et al. patent comprises the steps of: (a) feeding continuous glass fiber strand material into a perforated mold to form a wool product in the mold; (b) feeding a binder in powdered form into the mold; (c) curing the binder to bond together portions of the strand material forming the compacted wool product such that a preform is formed having generally the shape of the mold; (d) opening the mold; and (e) removing the preform from the mold.

U.S. Pat. No. 5,976,453 to Nilsson et al. discloses a device and process for expanding strand material to densities as low as 30 grams/liter. Specifically, glass fiber roving is passed through a texturizing gun at feeding speeds of up to 400 meters/minute to 600 meters/minute simultaneously with pressurized gas at pressures up to 7.0 bars in order to produce a wool-like product suitable for use as acoustic and/or thermal insulation in automotive and industrial applications.

The present invention relates to a new method or process for producing a wool-type material of relatively low density including densities below 30 grams/liter which exhibit beneficial acoustic and/or thermal insulating properties suited for a multitude of automotive and industrial applications.

SUMMARY OF THE INVENTION

The present invention relates to a method of co-texturizing reinforcing fibers and thermoplastic fibers. The method comprises the steps of passing a continuous reinforcing fiber strand or roving through a texturizing gun, simultaneously passing a thermoplastic fiber strand or roving through the texturizing gun with the reinforcing fiber strand and injecting pressurized air into the texturizing gun concurrently with the reinforcing fiber and thermoplastic fiber strands. This method produces a co-texturized, composite wool-type product having densities ranging from about 20–200 grams/liter, preferably from about 20 grams/liter to less than about 30 grams/liter, and exhibiting beneficial acoustical and/or thermal insulating properties.

The reinforcing fiber strand may, for example, be any commercially available continuous glass fiber strand made from E-glass or S-glass fibers or a carbon fiber strand that is resistant to high levels of heat. The continuous thermoplastic fiber strand may be made from any appropriate thermoplastic fiber material known in the art including but not limited to polypropylene, polyethylene, polyethylene terephthalate, nylon and any mixtures thereof.

The reinforcing fiber strand and the thermoplastic fiber strand are passed or fed through the texturizing gun at a rate of between approximately 300–600 meters/minutes and more typically about 400 meters/minute. The pressurized air may be injected into the texturizing gun at pressures ranging from about 1.0–7.0 bars and more typically about 3.0 bars. Still further, the reinforcing fiber strand and thermoplastic fiber strand may be passed through the texturizing gun in amounts so as to produce a co-texturized composite product of from about 1 to 99% and more typically from about 20 to about 85% by weight reinforcing fiber.

The co-texturized product may, for example, be blown from the texturizing gun directly into an assembled product or into a mold. In the alternative, the method may include the step of placing the co-texturized reinforcing and thermoplastic fiber material discharged from the texturizing gun into a bag. Typically, the bag is constructed from a thermoplastic material such as but not limited to polypropylene, polyethylene, polyethylene terephthalate, nylon and any mixtures thereof The bag and the co-texturized reinforcing and thermoplastic fiber contents thereof may then be subsequently used as a load for a molding machine and molded under heat and pressure into a desired shape for any appropriate application.

In accordance with yet another aspect of the present invention, a cotexturized fiber material is provided. That co-texturized fiber material comprises between 1–99% by weight reinforcing fiber material and 1–99% by weight thermoplastic fiber material and more typically between about 20–85% by weight reinforcing fiber material and 15–80% by weight thermoplastic fiber material. The co-texturized material has an overall density of from about 20 grams/liter to about 200 grams/liter and preferably from about 20 grams/liter to less than about 30 grams/liter. The continuous reinforcing fiber material may be selected from a group consisting of glass fibers (e.g. E-glass fibers, S-glass fibers), carbon fibers and any mixtures thereof. The thermoplastic fibers may be selected from a group of materials consisting of polypropylene, polyethylene, polyethylene terephthalate, nylon and any mixtures thereof. It should be appreciated, however, that the specific continuous reinforcing fibers and thermoplastic fiber materials listed are only being presented for purposes of illustration and are not to be considered as restrictive.

Still other benefits and advantages of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and forming a part of the specification illustrates several aspects of the present invention and together with the description serves to explain the principles of the invention. In the drawing.

Figure 1:
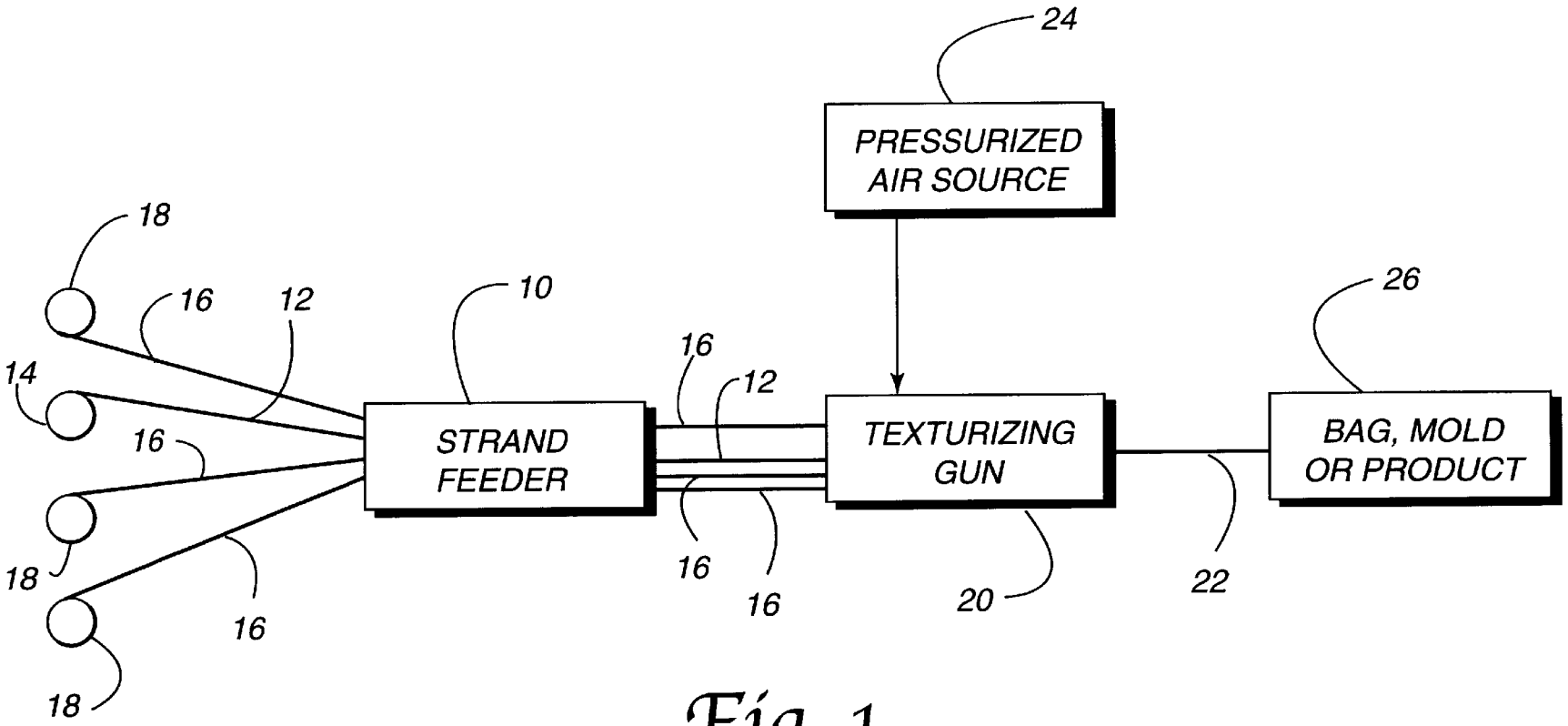
FIG. 1 is a schematical illustration of the method of the present invention.

Reference will now be made in detail to the present preferred embodiment of the invention, an example of which is illustrated in the accompanying drawing.

DETAILED DESCRIPTION OF THE INVENTION

Reference is now made to the FIGURE schematically showing the method of the present invention for co-texturizing continuous reinforcing fibers and thermoplastic fibers. Specifically, a strand feeder 10 comprising one or more strand feeding mechanisms feed at least one continuous reinforcing fiber strand 12 from a spool source 14 and one or more continuous thermoplastic fiber strands 16 from one or more spool sources 18 to a texturizing gun 20. Such a strand feeder 10 may simply feed a metered amount or quantity of each strand 12, 16 to the texturizing gun 20. Alternatively, the strand feeder 10 may both feed a metered amount or quantity of each strand 12, 16 and also complete some texturizing of one or more of the strands by separating the individual fibers. Examples of strand feeders 10 known in the art include the feeding mechanism shown and described in U.S. Pat. No. 4,569,471 to Ingemansson et al. (the full disclosure of which is incorporated herein by reference) and the commercially available SILENTEX machine. The texturizing gun 20 is of a type well known in the art such as disclosed in U.S. Pat. No. 5,976,453 to Nilsson et al. or U.S. Pat. No. 5,766,541 to Knutsson et al. The full disclosure of these two patents is also incorporated herein by reference.

The continuous reinforcing fiber strand 12 may, for example, be any commercially available carbon fiber strand formed from a plurality of carbon fibers or glass fiber strand formed from a plurality of glass fibers. An example of such a strand is a commercially available roving. Such a roving will typically have a density of between about 0.5–2.0 grams/yard. Glass fiber strands are preferred for many applications such as muffler filler material as glass fibers are resistant to the high levels of heat produced in the interior of an engine exhaust muffler. The strands may be formed from continuous E-glass or S-glass fibers. Still, it is also contemplated that the strand material may be formed from other continuous reinforcing fibers which, preferably, are resistant to heat.

The thermoplastic fiber strand or strands 16 are formed from a plurality of thermoplastic fibers. Again, an example of such a strand is a commercially available thermoplastic roving. Such a roving will typically have a density of between about 0.2–1.5 grams/yard. The thermoplastic fiber material may be selected from a group consisting of polypropylene, polyethylene, polyethylene terephthalate, nylon and any mixtures thereof. It is further contemplated that the strand material may be formed from other thermoplastic fibers suited to the particular application in question.

The strand feeder 10 and texturizing gun 20 function together to pass a selected amount or quantity of reinforcing fiber strand 12 and thermoplastic fiber strand 16 through the texturizing gun 20 so as to produce a co-texturized composite product 22 comprising between about 199% by weight reinforcing fiber and 1–99% by weight thermoplastic fiber and more typically 20–85% by weight reinforcing fiber and 15–80% by weight thermoplastic fiber. The co-texturized composite product typically has an overall density of from about 20 grams/liter to about 200 grams/liter and preferably from about 20 grams/liter to less than about 30 grams/liter.

More particularly describing the invention, the reinforcing fiber strand 12 and thermoplastic fiber strands 16 are passed through the texturizing gun simultaneously at a rate of approximately 300–600 meters/minute. Simultaneously, pressurized air from a pressurized air source 24 is injected into the texturizing gun 20 at a pressure of about 1.0–7.0 bars and typically about 3.0 bars. Together, the strand feeder 10 and the pressurized air in the texturizing gun 20 draw the appropriate amount or quantity of reinforcing fiber strand 12 from the spool 14 and thermoplastic fiber strands 16 from the spools 18 to produce the desired product. As the strands 12, 16 pass through the texturizing gun 20 the strand material is expanded and fluffed into a wool-like product. Specifically, the reinforcing fiber and thermoplastic fiber strands 12, 16 are co-texturized with good reinforcing fiber dispersion in the thermoplastic fibers. Accordingly, the thermoplastic fibers act as a matrix resin and the glass or carbon fibers function as a reinforcement. The resulting composite product exhibits a number of beneficial strength and molding properties.

As shown in the FIGURE, the resulting composite product 22 may be delivered directly into a cavity of a final product (e.g. a muffler shell), or directly into a mold for heat and/or pressure molding into a desired shape. For example, the co-texturized composite product 22 may be molded into a preform for a muffler. For such an application, the composite product 22 typically comprises about 95–99% by weight glass fiber and about 1–5% thermoplastic fiber. The thermoplastic fiber acts as a binder to hold the glass fibers in the desired shape for subsequent installation of the preform into the shell of a muffler. After the finished muffler is installed on a vehicle, hot exhaust gases generated by the engine of the vehicle drive off the remaining thermoplastic fiber binder leaving the glass fiber to expand, fill the muffler shell and provide the desired noise attenuation.

In yet another alternative, the composite material 22 is placed into a bag 26 which may be formed from a thermoplastic material such as polypropylene, polyethylene, polyethylene terephthalate, nylon and mixtures thereof. The bag 26 with its composite product 22 held therein may be subsequently used as a load for a molding machine and molded under heat and/or pressure into the desired shape for any appropriate application including as a filler material in a muffler.

The following example is presented to further illustrate the invention but it is not to be considered as limited thereto.

EXAMPLE 1

A sample of glass roving, 1.13 grams/yard (coated with a polypropylene compatible size) and with a tex of 1235, about 2000 filaments and about 16 micron filament diameter was co-texturized with three tows of polypropylene fiber (each tow was 0.53 gram/yard). The ratio of glass to polypropylene was 1.13/1.59=0.71. The percent glass content of the texturized material was 1.13/2.72×100 or 42%.

Some of this texturized material was placed on a ⅛" thick steel plate with a 6"×6" square hole. The steel plate and texturized material were placed in a hot press and molded. The mold temperature was approximately 400° F. and pressure was estimated to be 300 psi and molding time was estimated to be ten minutes. The molded part was cooled and removed from the plate and a 42% glass/polypropylene laminate was produced weighing 103 grams.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, while the invention as illustrated shows the passing of the thermoplastic fiber strands 16 through the strand feeder or SILENTEX machine, the thermoplastic fiber strand may be fed in metered quantity directly into the texturizing gun without undergoing any pretexturization. Still further, rather than processing separate reinforcing fiber and glass fiber strands, one or more strands of commingled reinforcing fibers and thermoplastic fibers may be co-texturized in accordance with the present invention.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A method of co-texturizing continuous reinforcing fibers and thermoplastic fibers, comprising:

passing a continuous glass reinforcing fiber strand coated with a polypropylene compatible sizing, wherein said glass reinforcing fiber is selected from a group consisting of E-glass fibers, S-glass fibers and mixtures thereof, through a texturizing gun;

simultaneously passing a thermoplastic fiber strand through said texturizing gun with said reinforcing fiber strand; and injecting pressurized air into said texturizing gun concurrently with said reinforcing fiber and thermoplastic fiber strands.

2. The method of claim 1, further including placing co-texturized reinforcing fiber and thermoplastic fiber strands discharged from said texturizing gun into a bag.

3. The method of claim 2, further including making said bag from a thermoplastic material.

4. The method of claim 2, further including making said bag from a thermoplastic material selected from a group consisting of polypropylene, polyethylene, polyethylene terephthalate, nylon and any mixtures thereof.

5. The method of claim 1, further including selecting a thermoplastic fiber material from a group consisting of polypropylene, polyethylene, polyethylene terephthalate, nylon and mixtures thereof.

6. The method of claim 1, further including passing said reinforcing fiber strand through said texturizing gun at a rate of about 300–600 meters/minute.

7. The method of claim 1, further including passing said thermoplastic fiber strand through said gun at a rate of about 300–600 meters/minute.

8. The method of claim 1, further including injecting said pressurized air into said gun at about 1.0–7.0 bars.

9. The method of claim 1, further including passing said reinforcing fiber strand and said thermoplastic fiber strand through said texturizing gun so as to produce a co-texturized composite product up to 85% glass fiber by weight.

* * * * *